US007950319B2

(12) United States Patent
Lee

(10) Patent No.: US 7,950,319 B2
(45) Date of Patent: May 31, 2011

(54) CUTTING DEVICE

(75) Inventor: Han-Lung Lee, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 392 days.

(21) Appl. No.: 12/206,938

(22) Filed: Sep. 9, 2008

(65) Prior Publication Data

US 2009/0255392 A1 Oct. 15, 2009

(30) Foreign Application Priority Data

Apr. 14, 2008 (CN) ..... 2008 1 0301122

(51) Int. Cl.
*B26D 7/10* (2006.01)

(52) U.S. Cl. ..... 83/651.1; 83/956

(58) Field of Classification Search ..... 83/651.1, 83/956

See application file for complete search history.

(56) References Cited

U.S. PATENT DOCUMENTS 4,673,787 A * 6/1987 Inoue ..... 219/69.12
5,533,430 A * 7/1996 Buch ..... 83/651.1
6,925,693 B2 * 8/2005 Takeuchi et al. ..... 83/29

FOREIGN PATENT DOCUMENTS

JP 03155488 A * 7/1991
KR 20020052423 * 7/2002

* cited by examiner

*Primary Examiner* — Stephen Choi
(74) *Attorney, Agent, or Firm* — Clifford O. Chi

(57) ABSTRACT

A cutting device includes a substrate, a supporting arm mounted on the substrate, a driving component supported by the supporting arm, and a cutting member. The cutting member includes a connection member and a cutting wire. The connection member includes an attachment portion connected to the driving component and a securing portion. The cutting wire is positioned on the securing portion.

8 Claims, 2 Drawing Sheets

CUTTING DEVICE

CROSS-REFERENCE STATEMENT

The present application is based on, and claims priority from, CN Application Serial Number 200810301122.9, filed on Apr. 14, 2008, titled "CUTTING DEVICE AND METHOD OF CUTTING", the disclosure of which is hereby incorporated by reference herein in its entirety.

The present application is related to a pending patent application, titled "APPARATUS AND METHOD FOR CUTTING INJECTION MOLDED PRODUCT", filed on Jul. 22, 2008 with the application Ser. No. 12/177,409 assigned to the same assignee as the present application, the disclosure of which is incorporated herein by reference.

BACKGROUND

1. Technical Field

The present disclosure generally relates to cutting devices and, more particularly, to a cutting device for cutting optical plastic components.

2. Description of Related Art

Optical components are often made of plastic by injection molding to attain a pre-finished assembly. The pre-finished assembly includes a positioning member, a plurality of integrally formed plastic lenses, and a plurality of temporary racks connecting the plurality of lenses to the positioning member. The pre-finished assembly is cut in a cutting area to separate the optical lenses from the temporary racks by a cutter. After being cut, the lenses need to be plated to improve their optical characteristics.

However, optical components cut by the cutter causes internal stresses in the optical components. In addition, optical components are generally cut one by one from the temporary racks, which cannot meet the demands of mass production.

Therefore, a new cutting device is desired to overcome the above-described shortcomings.

SUMMARY

An embodiment of a cutting device includes a substrate, a supporting arm mounted on the substrate, a driving component supported by the supporting arm, and a cutting member. The cutting member includes a connection member and a cutting wire. The connection member includes an attachment portion connected to the driving component and a securing portion. The cutting wire is positioned on the securing portion.

Other advantages and novel features will become more apparent from the following detailed description when taken in conjunction with the accompanying drawings.

BRIEF DESCRIPTION OF THE DRAWINGS

Many aspects of the cutting device can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION OF THE EMBODIMENT

Figure 1:
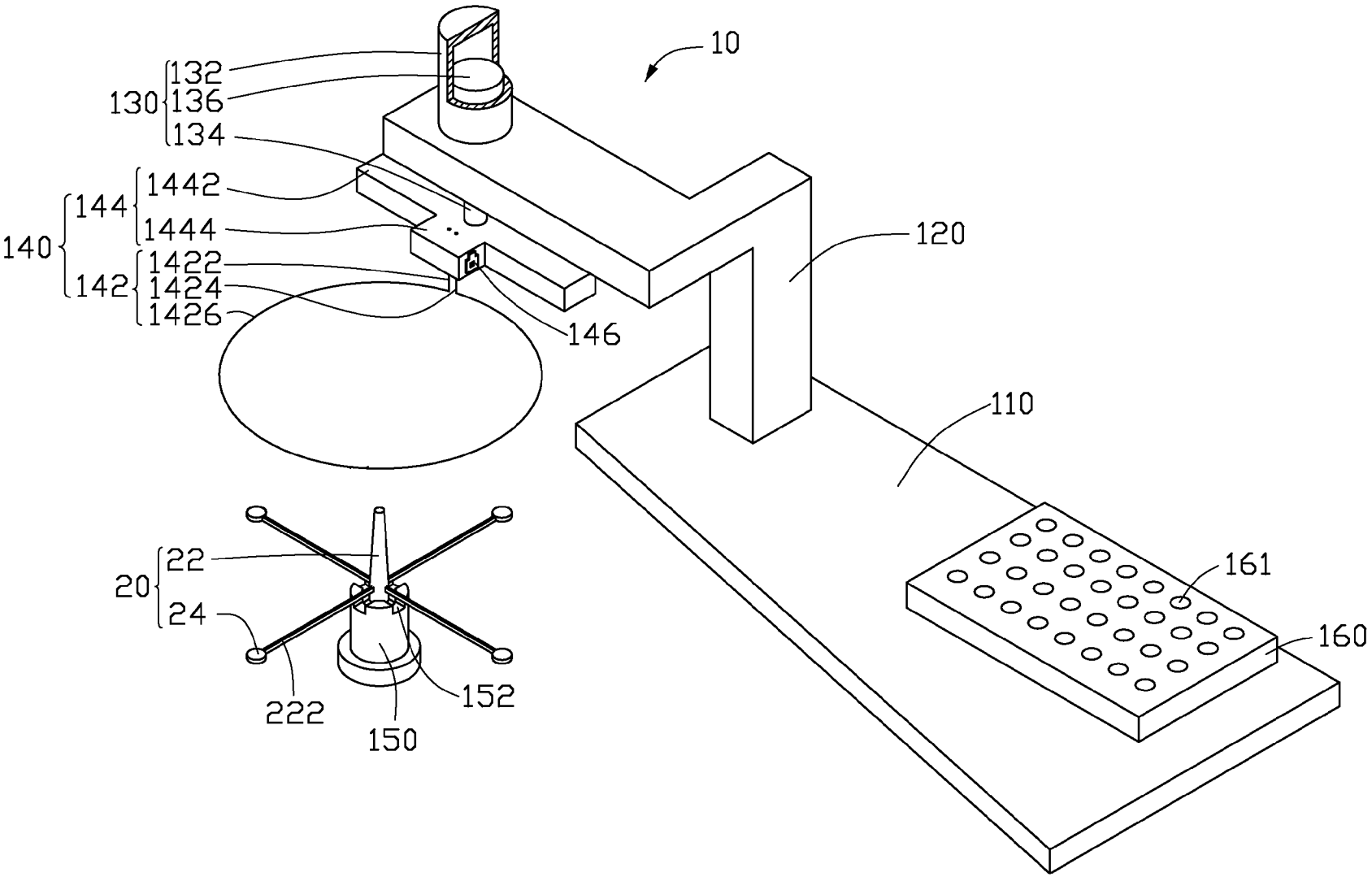
FIG. 1 is a perspective view of one embodiment of a cutting device.

Referring to FIG. 1, one embodiment of a cutting device 10 for cutting a pre-finished assembly 20 of optical plastic components includes a substrate 110, a supporting arm 120 mounted on the substrate 110, a driving component 130 supported by the supporting arm 120, a cutting member 140 connected to the driving component 130, and an assembly holder 150 configured to support the pre-finished assembly 20.

The substrate 110 includes a tray 160. A plurality of receiving recesses 161 is defined in the tray 160 and configured to receive finished optical plastic components.

The driving component 130 includes a piston housing 132, a piston 136 positioned inside the piston housing 132, and a piston rod 134 connected to the piston 136 and an air supply component (not shown). The piston housing 132 is secured on the supporting arm 120. The air supply component is configured to supply air to drive the piston 136 to move back and forth in the piston housing 132, so that the piston rod 134 can be driven to move away or towards the substrate 110.

The cutting member 140 includes a cutting wire 142 and a connection member 144. The connection member 144 includes an attachment portion 1442 and a securing portion 1444. The attachment portion 1442 is connected to the piston rod 134. The cutting wire 142 may be made of a thermally conductive material, such as steel, copper, and tungsten. The cutting wire 142 includes a first connection portion 1422, a second connection portion 1424, and a cutting portion 1426 connected to the first and second connection portion 1422, 1424. The first and second connection portion 1422, 1424 are secured to the securing portion 1444 and configured to connect to a negative electrode and a positive electrode of a power supply. In the embodiment of FIG. 1, the cutting portion 1426 may be circular shaped.

An ultrasonic generating component 146 may be secured on the securing portion 1444 to generate an ultrasonic vibration to the cutting wire 142 to improve the cutting effect. The ultrasonic generating component 146 may be made of piezoelectric materials, such as barium titanate ($BaTiO_3$) and lithium niobate ($LiNbO_3$).

In the embodiment of FIG. 1, for exemplary purposes only, the pre-finished assembly 20 includes four lenses 24, a position member 22, and four temporary racks 222 connecting the four lenses 24 to the position member 22. The assembly holder 150 defines a plurality of positioning recesses 152 therein to receive the temporary racks 222.

Figure 2:
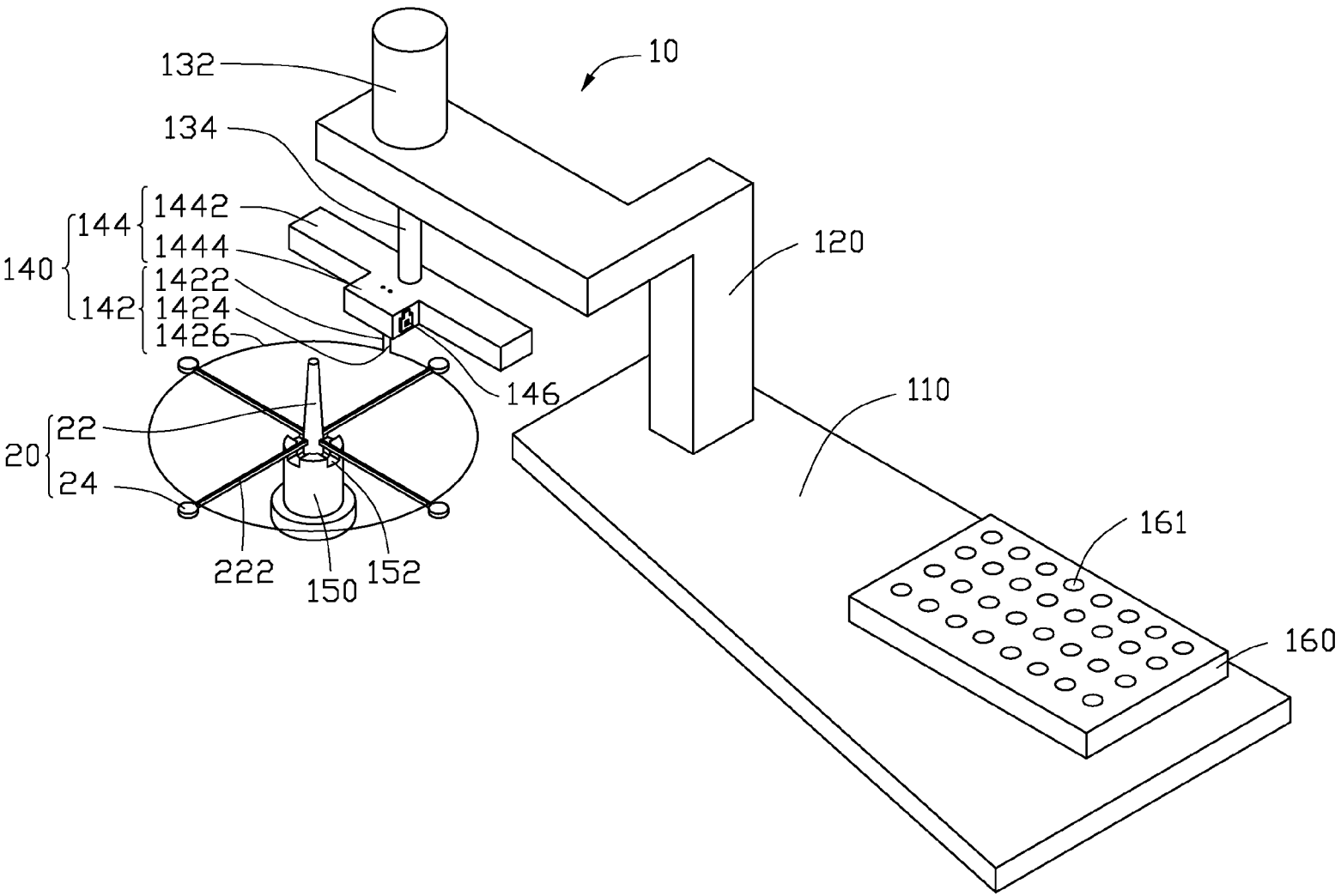
FIG. 2 is a perspective view of the cutting device of FIG. 1, in a working state.

Referring to FIG. 2, in use, the pre-finished assembly 20 is positioned on the assembly holder 150. The four temporary racks 222 are received in the positioning recesses 152. The cutting wire 142 is connected to a power supply and heated. The ultrasonic generating component 146 is turned on to generate an ultrasonic vibration to the cutting wire 142. The driving component 130 drives the piston rod 134 and the connection member 144 towards the assembly holder 150, and the heated cutting wire 142 cuts the lenses 24 to separate the lenses 24 from the temporary racks 222. The detached lenses 24 are then delivered into the plurality of receiving recesses 161.

In the embodiment of FIGS. 1 and 2, the cutting wire 142 is heated to cut off the lenses 24 from the temporary racks 222, which can avoid cracks and internal stress occurring in the detached lenses 24. In addition, the lenses 24 can all be cut off from the temporary racks 222 in one time, which can improve production efficiency. Moreover, the ultrasonic generating component 146 can improve cutting efficiency.

It is believed that the present embodiment and their advantages will be understood from the foregoing description, and it will be apparent that various changes may be made thereto without departing from the spirit and scope of the invention or sacrificing all of its material advantages, the examples here before described merely being preferred or exemplary embodiments of the invention.

What is claimed is:

1. A cutting device for cutting a pre-finished assembly, the pre-finished assembly includes a plurality of lenses, a position member, and a plurality of temporary racks connecting the lenses to the position member, the lenses being arranged in an imaginable circle, the cutting device comprising:

a substrate;

a supporting arm mounted on the substrate;

a driving component supported by the supporting arm; and a cutting member comprising:

a connection member comprising an attachment portion connected to the driving component and a securing portion;

a cutting wire positioned on the securing portion, the cutting wire being in a circular shaped configuration corresponding to the arrangement of the lenses in the imaginable circle; and a power supply connected to the cutting wire to heat the cutting wire, wherein the driving component moves the heated cutting wire toward the pre-finished assembly to cut the lenses in an asynchronous manner, thus separating the lenses from the temporary racks.

2. The cutting device of claim 1, wherein the cutting wire comprises a first connection portion, a second connection portion, and a cutting portion connected to the first and second connection portion; the first connection portion is secured to the securing portion and configured to connect to a negative electrode of a power supply; the second connection portion is secured to the securing portion and configured to connect to a positive electrode of the power supply.

3. The cutting device of claim 1, wherein the cutting wire is made of a material selected from the group consisting of steel, copper, and tungsten.

4. The cutting device of claim 1, further comprising an ultrasonic generating component, wherein the ultrasonic generating component is positioned on the securing portion and configured to generate an ultrasonic vibration to the cutting wire.

5. The cutting device of claim 4, wherein the ultrasonic generating component is made of a material selected from a group consisting of barium titanate and lithium niobate.

6. The cutting device of claim 1, wherein the driving component comprises a piston housing, a piston positioned inside the piston housing, and a piston rod connected to the piston and the attachment portion; the piston housing is positioned on the supporting arm.

7. The cutting device of claim 1, wherein the substrate has a tray; a plurality of receiving recesses is defined in the tray.

8. The cutting device of claim 1, further comprising an assembly holder; a plurality of positioning recesses is defined in the assembly holder.

* * * * *